US008973715B2

(12) United States Patent
Quinn

(10) Patent No.: US 8,973,715 B2
(45) Date of Patent: Mar. 10, 2015

(54) MOVABLE BODY DERAILMENT DETECTION SYSTEM

(75) Inventor: Daniel Quinn, Budd Lake, NJ (US)

(73) Assignee: Inventio AG, Hergiswil (CH)

( * ) Notice: Subject to any disclaimer, the term of this patent is extended or adjusted under 35 U.S.C. 154(b) by 602 days.

(21) Appl. No.: 13/372,710

(22) Filed: Feb. 14, 2012

(65) Prior Publication Data

US 2013/0206515 A1 Aug. 15, 2013

(51) Int. Cl.
*B66B 1/34* (2006.01)

(52) U.S. Cl.
USPC ..... 187/393; 187/278

(58) Field of Classification Search
USPC ..... 187/247, 277, 278, 250, 390–394, 406, 187/414
See application file for complete search history.

(56) References Cited

U.S. PATENT DOCUMENTS

| | | | | |
|---|---|---|---|---|
| 4,056,169 | A * | 11/1977 | Showalter | 187/278 |
| 4,096,925 | A * | 6/1978 | Koob et al. | 187/394 |
| 4,102,437 | A * | 7/1978 | Mandel | 187/399 |
| 4,106,594 | A * | 8/1978 | Kirsch et al. | 187/278 |
| 4,643,276 | A * | 2/1987 | Philobos | 187/278 |
| 8,256,582 | B2 * | 9/2012 | Qiu | 187/406 |
| 8,602,173 | B2 * | 12/2013 | Berner | 187/393 |
| 2012/0097487 | A1 * | 4/2012 | Winey | 187/393 |

FOREIGN PATENT DOCUMENTS

| | | | |
|---|---|---|---|
| CN | 101628677 | A | 1/2010 |
| CN | 101628677 | B | 2/2012 |
| JP | 53091250 | A | 8/1978 |
| JP | 07149482 | A | 6/1995 |
| JP | 09301650 | A | 11/1997 |
| JP | 11035245 | A | 2/1999 |

* cited by examiner

*Primary Examiner* — Anthony Salata
(74) *Attorney, Agent, or Firm* — Fraser Clemens Martin & Miller LLC; William J. Clemens

(57) ABSTRACT

An elevator installation has a guide rail of a predetermined length and a movable body configured to move along the guide rail up and down a hoistway. A proximity sensor is mounted on the movable body to be in a predetermined proximity of the guide rail. The proximity sensor is configured to detect whether or not the proximity sensor is at the predetermined distance to the guide rail. A controller coupled to the proximity sensor acts upon an indication that the proximity sensor is not at the predetermined distance to the guide rail to switch the elevator installation to a secure state.

14 Claims, 3 Drawing Sheets

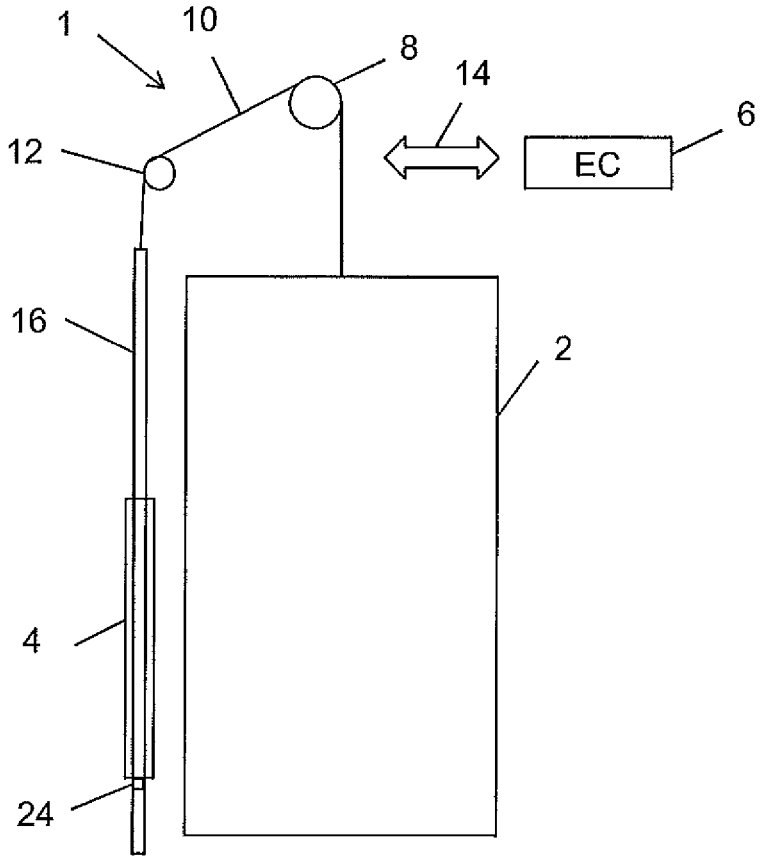
Fig. 1
Fig. 4
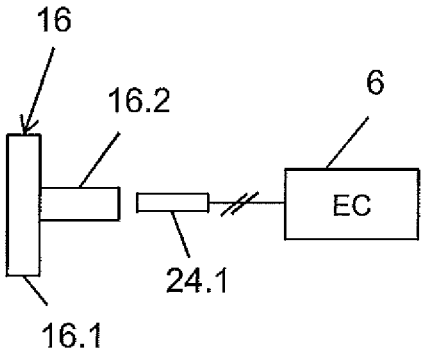

MOVABLE BODY DERAILMENT DETECTION SYSTEM

BACKGROUND OF THE INVENTION

The various embodiments described herein generally relate to elevator installations. More particularly, the various embodiments described herein relate to detecting an abnormal travel behavior of a movable body travelling along a guide rail, such as an actual or potential derailment of the movable body.

Multi-story buildings are usually equipped with at least one elevator installation. In a generally known elevator installation, a suspension medium—such as a rope or flat belt-type rope—interconnects a counterweight and a cabin, and an electrical drive motor causes the suspension medium to move in order to thereby move the counterweight and the cabin up and down along a shaft or hoistway. In such an elevator installation, counterweight guide rails are installed in the shaft to guide the counterweight when it moves up and down. Similarly, installed cabin guide rails guide the cabin on its way up and down the shaft. These guide rails ensure that the guided bodies, i.e., the counterweight and cabin, stay within their defined spaces and paths, and, hence, do not collide with each other or with a shaft wall.

An earthquake poses a severe risk for an elevator installation in a multi-story building and the passengers using the elevator installation at the time the earthquake occurs. For that reason, certain elevator codes (e.g., European Code EN81 or US Code A 17.1-2010) require a safety mechanism that detects if a counterweight leaves a guide rail (also referred to as "the counterweight derails") during an earthquake, or has left the guide rail as a result of the earthquake. A common safety mechanism is based on a ring-and-string concept: an energized cord (string) runs next to the counterweight up the length of the hoistway and passes through a ring attached to the counterweight. If the counterweight leaves a guide rail, the ring contacts the string. The contact causes the cord to be grounded via the counterweight, and a controller of the elevator installation reacts upon detecting such grounding. The clearance between the cord and the ring is relatively low, e.g., about 25 mm. Wind, however, may cause tall buildings to sway more than the clearance and cause the cord to contact the ring leading to false detections.

Patent abstract JP11035245 discloses a mechanism that detects a derailment when a target plate on a counterweight interrupts a laser beam. In tall buildings, the laser beam bridges the long distance between the bottom and the head of the shaft. Sway caused by wind may, therefore, also lead to false detections. Furthermore, positioning a laser source in a shaft may lead to other concerns, such as the safety of a service technician or optical degradation due to dirt on the laser source or the laser beam detector. Also, smoke caused by a smoldering fire or actual fire may interfere with the laser beam.

Another mechanism, disclosed in patent abstract JP07149482, uses a derail detector installed at a guide shoe. The derail detector detects if a slider contacts a guide rail. In order for such a mechanical slider to reliably function, the slider must be regularly serviced to ensure its mobility or to detect wear. Also, such a mechanical slider may cause additional noise, in particular at higher speeds.

In view of these known mechanisms and associated concerns, there is a need for an alternative mechanism for detecting an abnormal travel behavior of a movable body travelling along a guide rail.

SUMMARY OF THE INVENTION

Accordingly, on aspect of such an alternative mechanism involves an elevator installation having a guide rail of a predetermined length and a movable body configured to move along the guide rail up and down a hoistway. The elevator installation includes further a proximity sensor mounted on the movable body to be at a predetermined distance to the guide rail. The proximity sensor is configured to detect whether or not the proximity sensor is at the predetermined distance to the guide rail. In addition, the elevator installation includes a controller coupled to the proximity sensor to act upon an indication that the proximity sensor is not at the predetermined distance to the guide rail to switch the elevator installation to a secure state.

Another aspect of the alternative mechanism involves a method of operating an elevator installation, in which a movable body travelling along a guide rail of the elevator installation is subject to an abnormal travel behavior. An electrical circuit having a proximity sensor mounted on the movable body to be at a predetermined distance to the guide rail and configured to detect whether or not the proximity sensor is at the predetermined distance to the guide rail is monitored for an indication that the proximity sensor is not at the predetermined distance to the guide rail. The elevator installation is switched to a secure state in response to the indication that the proximity sensor is not at the predetermined distance to the guide rail.

A proximity sensor is positioned at a distance to an object and does not physically touch the object. Advantageously, a proximity sensor is not subject to degrading wear and tear. In addition, the various kinds of proximity sensors that are commercially available, such as capacitive sensors, inductive sensors, magnetic sensors, optical sensors and radar sensors, provide flexibility in that a suitable sensor type can be selected, e.g., depending on the material of the object.

The proximity sensor is positioned to face a front area of a guide rail blade. In horizontal direction, the front area is relatively narrow. This improves the system's sensitivity because a relatively minor deviation from the front-facing position indicates a derailment.

In one embodiment, the elevator installation includes at least two proximity sensors, each mounted on the counterweight to face a front area of a counterweight blade. The proximity sensors can be mounted at different locations on the counterweight. Advantageously, this further improves the system because the proximity sensors monitor different parts of the counterweight. For example, a situation may exist in which only one side of the counterweight derailed while the other side is still correctly guided. In that situation, one proximity sensor indicates a derailment and the other indicates normal operation. To switch the elevator installation to a secure state, however, it is sufficient if only one proximity sensor indicates a derailment.

If at least two proximity sensors are used, they are preferably connected in series in an electrical circuit coupled to the controller. The electrical circuit is closed during normal operation of the elevator installation. In a serial arrangement, if one proximity sensor indicates a derailment, the electrical circuit as a whole is disrupted. For example, if each proximity sensor is configured as a proximity switch, an open switch indicates a derailment and disrupts the electrical circuit.

The serial arrangement of the proximity sensors facilitates implementing a monitoring/detection mechanism in the elevator installation. That is, the indication that the proximity sensor is not at the predetermined distance to the guide rail is a predetermined voltage, or current, which is not detectable by the controller when the electrical circuit is disrupted. Detecting or measuring a voltage or current and determining if it deviates from the predetermined voltage or current can be implemented with an analog or digital circuit of low complexity.

BRIEF DESCRIPTION OF THE SEVERAL VIEWS OF THE DRAWINGS

The novel features and method steps characteristic of the invention are set out in the claims below. The invention itself, however, as well as other features and advantages thereof, are best understood by reference to the detailed description, which follows, when read in conjunction with the accompanying drawings, wherein:

FIG. 1 shows a schematic illustration of one embodiment of an elevator installation having a cabin and a counterweight;

FIG. 4 is a schematic illustration of an arrangement of a sensor of the derailment detection system with respect to a guide rail.

DETAILED DESCRIPTION OF THE INVENTION

Figure 2:
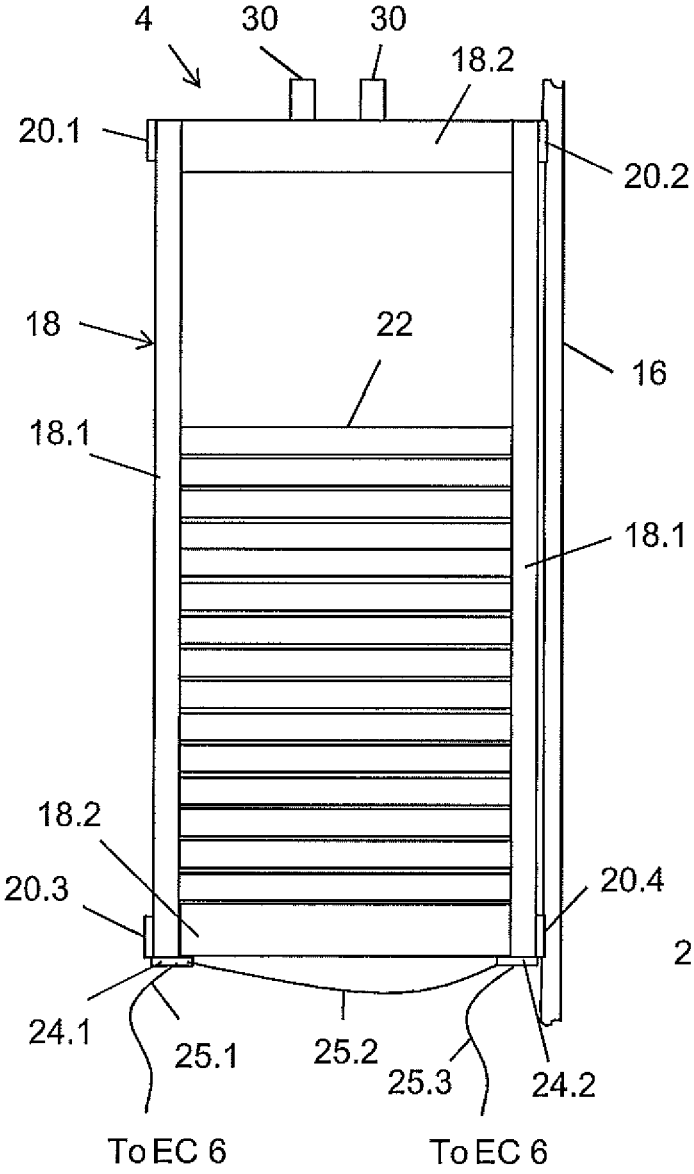
FIG. 2 is a schematic illustration of a front view of one embodiment of a counterweight having a derailment detection system for use in the elevator installation shown in FIG. 1.

FIG. 1 schematically illustrates—in a side view—one embodiment of an elevator installation 1, e.g., installed in a building. The elevator installation 1 includes a cabin 2 connected via a suspension medium 10 (e.g., one or more round ropes or flat belt-type ropes) to a counterweight 4, wherein the cabin 2 and the counterweight 4 are movable up and down in opposite directions in a vertically extending shaft or hoistway. The elevator installation 1 includes a derailment detection system 24 coupled to an elevator controller 6 of the elevator installation 1. Briefly, the derailment detection system 24 is configured to detect an abnormal travel behavior of a movable body, such as the counterweight 4 or the cabin 2, or both, travelling along a guide rail. Guide rails for the cabin 2 are usually thicker and sturdier than counterweight guide rails. For that reason, derailment of a cabin 2 is usually less likely than a counterweight derailment, however, if it occurs, the consequences may be more serious. If an abnormal travel behavior is detected, the elevator controller 6 switches the elevator installation 1 to a secure state, e.g., by disabling operation of the elevator installation 1 according to a predetermined emergency routine. That is, for example, any moving cabin 2 is stopped, and any standing cabin 2 is prevented from moving. Embodiments of the derailment detection system 24, its components and function, are described below.

Referring again to the structure of the elevator installation 1 shown in FIG. 1, the terms "shaft" and "hoistway" are used herein interchangeably. Depending on a particular embodiment, the shaft may be surrounded by walls, e.g., four walls, or may not be completely enclosed as, e.g., in a so-called panorama elevator where a cabin with at least one transparent (e.g., glass) wall moves along only one wall of a building. Also, one of ordinary skill in the art will appreciate that in another embodiment an elevator installation may include more than one cabin, each moving in a separate shaft and coupled via a suspension medium to a counterweight. In yet another embodiment, more than one cabin may move within the same shaft. In these embodiments, each movable body may be monitored by a separate or common derailment detection system.

The exemplary elevator installation of FIG. 1 has guide rails for both the cabin 2 and the counterweight 4. These guide rails are installed within the shaft and guide the counterweight 4 and the cabin 2 along predetermined paths. The guide rails extend along the shaft and have lengths selected to guide the counterweight 4 and the cabin 2 between their respective lowermost and uppermost positions in the shaft. For ease of illustration, FIG. 1 shows a guide rail 16 for the counterweight 4 only, but not for the cabin 2; however, it is contemplated that the cabin 2 is guided by at least one guide rail as well. In a typical embodiment of an elevator installation, the shaft includes two guide rails for the counterweight 4 and two guide rails for the cabin 2.

A drive 8 is coupled to the suspension medium 10 and configured to act upon the suspension medium 10 to move the cabin 2 and the counterweight 4. These components are arranged in accordance with a 1:1 roping arrangement, however, other roping arrangements (e.g., 2:1) are possible as well. Next to the drive 8, a deflection sheave 12 is positioned above the counterweight 4 to deflect the suspension medium 10 between the drive 8 and the counterweight 4, as shown in FIG. 1, so that the cabin 2 and the counterweight 4 can move along different paths without colliding. It is contemplated that in another embodiment the positions of the drive 8 and the deflection sheave 12 are changed, i.e., the drive 8 is positioned above the counterweight 4 and the deflection sheave 12 above the cabin 2. FIG. 1 illustrates a situation in which the counterweight 4 is located in the hoistway at about the same height as the cabin 2; in that situation the counterweight 4 moves between the cabin 2 and a shaft wall (not shown).

In the embodiment of FIG. 1, the drive 8 and the deflection sheave 12 are positioned in an upper region of the hoistway, sometimes referred to as overhead space or head room. In another embodiment, the drive 8 and the deflection sheave 12 may be arranged in the pit of the shaft, or next to a shaft wall between the shaft wall and the cabin 2 so that the cabin 2 may drive past the drive 8. Furthermore, in one embodiment, the elevator installation 1 is a traction-type elevator, i.e., a drive sheave coupled to the drive 8 acts upon the suspension medium 10 by means of traction between the drive sheave and the suspension medium 10. In such an embodiment, the suspension medium 10 serves as a suspension and traction medium.

The foregoing illustrates that an elevator installation may have various configurations with regard to the disposition of its components (e.g., drive in overhead space or pit, with or without a deflection sheave, various roping arrangements (e.g., 1:1 or 2:1)) or the type of suspension medium used to move the counterweight 4 and the cabin 2. The skilled person, however, will appreciate that any kind of elevator installation in accordance with one of the various configurations may be used in connection with the derailment detection system 24 described herein, as long as a movable body (i.e., counterweight 4 and/or cabin 2) is guided by at least one guide rail and subject to derailment. As such, use of the derailment detection system 24 is not limited to a particular configuration of the elevator installation 1.

The elevator controller 6 (in FIG. 1 labeled as EC for elevator controller) of the elevator installation 1 interacts with various components of the elevator installation 1, as indicated through a double arrow 14 in FIG. 1. The elevator controller 6 is configured to control and monitor the performance and operation of the elevator installation 1, as is known in the art.

In addition, the elevator controller 6 is communicatively coupled to the derailment detection system 24 to take an active part in switching the elevator installation 1 to a secure state following an indication of derailment.

Figure 3:
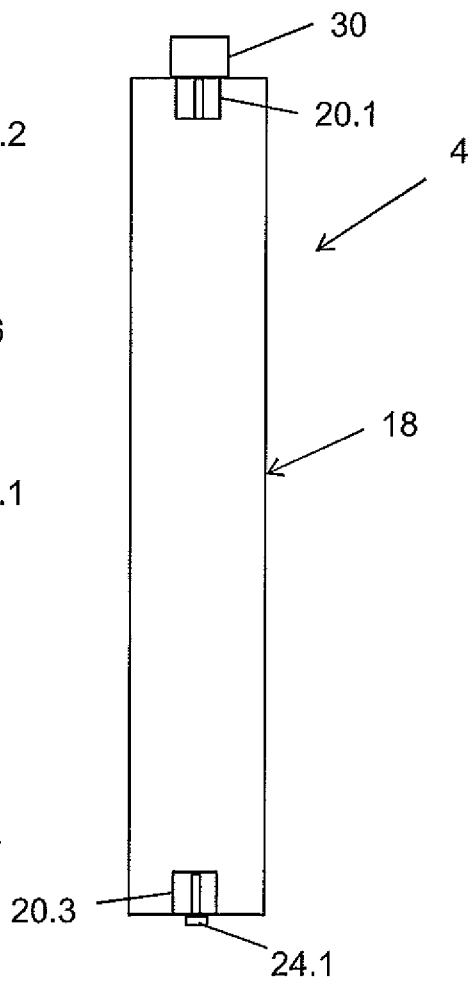
FIG. 3 is a schematic illustration of a side view of the counterweight and derailment detection system of FIG. 2.

FIG. 2 is a schematic illustration of a front view of one embodiment of the counterweight 4 supporting at least some components of the derailment detection system 24, and FIG. 3 is a side view of the counterweight 4. As shown in FIG. 2, the counterweight 4 includes a frame 18 formed by vertical elements 18.1 and lower and upper cross elements 18.2 that extend between the vertical elements 18.1. At least one weight element 22 is arranged within the frame 18. Typically, a plurality of weight elements 22 is stacked into the frame 18 until a desired total weight for the counterweight 4 is reached. The total weight is usually set at: weight of the cabin 2 plus 50% of its rated load. To couple the suspension medium 10 to the counterweight 4, pulleys 30 are connected to the upper cross element 18.2 of the frame 18. Even though FIG. 2 shows two pulleys 30, it is contemplated that only one, or more than two pulleys 30 may be provided.

The counterweight 4 includes further guide shoes 20.1-20.4 mounted on the frame 18 (e.g., on the vertical elements 18.1) to face the guide rails 16. In the illustrated embodiment, at each outer corner of the frame 18, a guide shoe 20.1-20.4 is positioned. However, it is contemplated that fewer (or even more) guide shoes may be provided or that the guide shoes are positioned on the frame 18 at other locations. Further, the guide shoes 20.1-20.4 may be configured as slide guides or roller guides. In the embodiment shown in FIG. 3, each guide shoe 20.1-20.4 is configured as a slide guide having a slot sized to slidably receive a part of the guide rail 16. As illustrated in FIG. 4, the guide rail 16 has a T-shaped cross section formed by a base 16.1 and a blade 16.2 that extends about perpendicularly from the base 16.1. In operation, the blade 16.2 slides in the slot of a guide shoe 20.1-20.4. It is contemplated that, even though T-shaped guide rails are usually used, the various embodiments of a mechanism for detecting an abnormal travel behavior described herein, are not limited to T-shaped guide rails.

As mentioned with reference to FIG. 1, the counterweight 4 supports components of the derailment detection system 24. In the illustrated embodiment, these components include proximity sensors 24.1, 24.2 and cables 25.1, 25.2, 25.3. The proximity sensor 24.1 is positioned at a bottom surface on one side (the left side in FIG. 1) of the counterweight 4, and the proximity sensor 24.2 is positioned at the bottom surface on another side (the right side in FIG. 1) of the counterweight 4.

The proximity sensors 24.1, 24.2 used in the derailment detection system 24 are noncontact sensors; as such, they do not physically contact or touch the guide rails 16. In one embodiment, a proximity sensor 24.1, 24.2 outputs a sensor signal as a function of a distance to an object (also referred to as "target"), here, the guide rail 16. For example, a voltage of the sensor signal may increase the closer the object is to the proximity sensor. In another embodiment, a proximity sensor 24.1, 24.2 may be configured as a proximity switch that opens or closes an electrical circuit when it comes within a predetermined distance to the object. Conversely, the proximity sensor 24.1, 24.2 closes or opens the electrical circuit when it leaves the predetermined distance to the object. A proximity sensor 24.1, 24.2 may be configured as a capacitive sensor, an inductive sensor, a magnetic sensor, an optical sensor and a radar sensor, or any other sensor able to detect the presence of a nearby object without any physical contact. These kinds of sensors generate an electromagnetic field or emit electromagnetic radiation, and detect changes in the (electric or magnetic) field or (reflected) return signal, as is known to the skilled person.

In one embodiment, which is currently viewed as a preferred embodiment, the proximity sensors 24.1, 24.2 are inductive sensors because the targets are steel guide rails. Further, these inductive sensors are in this embodiment configured as proximity switches that open or close an electrical circuit when it comes within or leaves a predetermined distance to the target. Inductive sensors are commercially available, e.g., from Turck GmbH & Co. KG, Germany.

The proximity sensors 24.1, 24.2 are coupled to each other via a cable 25.2, and positioned—as shown in a schematic illustration of FIG. 4—to face a front area of the guide rail's blade 16.2. The proximity sensors 24.1, 24.2 are further connected to the cables 25.1, 25.3 forming an electrical circuit that is coupled to the elevator controller 6. The cables 25.1, 25.3 running to and from the elevator controller 6 may be part of a travel cable to the counterweight 4. As an alternative to a wired communication between the proximity sensors 24.1, 24.2 and the elevator controller 6, the communication may be based on wireless technology. In such an embodiment, a sensor signal is converted to a radio frequency (RF) signal—either within a proximity sensor, or through an external RF transceiver—and transmitted to an RF transceiver coupled to the elevator controller 6. It is contemplated that the electrical circuit including the proximity sensors 24.1, 24.2 still exists, even if wireless technology is used for some of the communication paths.

The proximity sensors 24.1, 24.2 and the cables 25.1, 25.2, 25.3 form the electrical circuit, to which the elevator controller 6 is coupled to take an active part in switching the elevator installation 1 to a secure state following an indication of a derailment. In this electrical circuit, the proximity sensors 24.1, 24.2, in one embodiment configured as proximity switches are connected in series. In the illustrated embodiment, the electrical circuit runs from an I/O interface of the elevator controller 6 via a cable (e.g., cable 25.1) of the travel cable to the counterweight 4, to one of the proximity sensors (e.g., 24.1) and via the cable 25.2 to the other proximity sensor (e.g., 24.2), and then to the elevator controller 6 via a further cable (e.g., cable 25.3) in the travel cable.

In this implementation of the derailment detection functionality, a 24V voltage (or any other suitable voltage used in the elevator installation 1) is supplied to one side of the electrical circuit (e.g., via cable 25.1) and the elevator controller 6 monitors the other side of the electrical circuit (e.g., cable 25.3), which serves as return path of the electrical circuit, to determine whether or not the 24V voltage is present. If one of the proximity sensors 24.1, 24.2 does not detect the guide rail 16 due to a derailment, the respective proximity sensor 24.1, 24.2 opens and disrupts the electrical circuit. As a consequence, the elevator controller 6 no longer detects the 24V voltage and changes from a "normal" operation to, e.g., 'earthquake service' operation as one example of a secure state. As a failsafe feature, if a proximity sensor 24.1, 24.2 were to fail or a cable were to break, the electrical circuit opens as well.

As described, the elevator controller 6 monitors the cable 25.2 to determine whether or not the 24V voltage is present at its I/O interface. For that purpose, the I/O interface may in one embodiment have a pull-down resistor with one terminal being grounded and the other being connected to the cable 25.2 and an input of a logic circuit. The input of the logic circuit is "high" (i.e., corresponding to 24V) only if the electric circuit is closed, i.e., all proximity sensors 24.1, 24.2 are closed). If the electric circuit is open, i.e., at least one proximity sensor 24.1, 24.2 is open, the input of the logic circuit is "low" (i.e., corresponding to 0V). The elevator controller 6 is programmed to process this digital voltage information. It is contemplated that the function of determining whether or not the 24V voltage is present may be implemented in various ways, e.g., by means of a voltage meter, with the function being realized in an I/O interface coupled to the elevator controller 6 or integrated to the elevator controller 6 itself.

In the foregoing description of one embodiment of the derailment detection system 24, the determination of a derailment is based on measuring or monitoring a voltage. The skilled person, however, will appreciate that instead of a voltage an electrical current can be measured or monitored, as is known in the field of measuring electrical characteristics or parameters.

Figure 5:
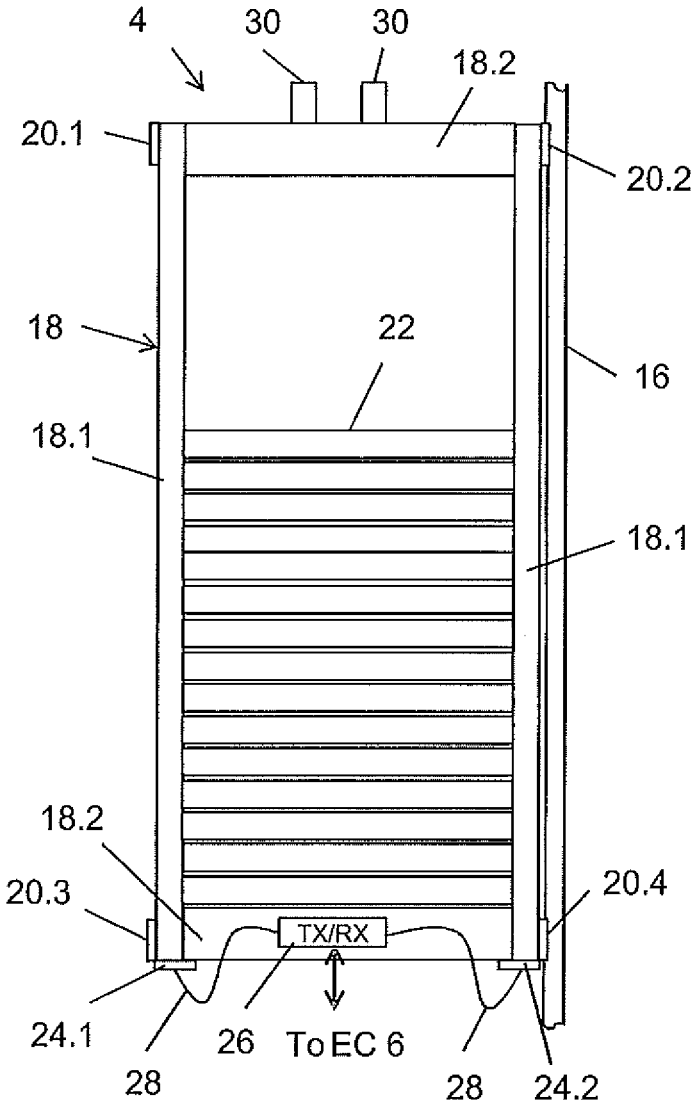
FIG. 5 is a schematic illustration of a front view of a counterweight with another embodiment of a derailment detection system.

FIG. 5 is a schematic illustration of a front view of a counterweight 4 with another embodiment of a derailment detection system. In this embodiment, the derailment detection system 24 includes the proximity sensors 24.1, 24.2, each coupled to a controller unit 26 mounted to the counterweight 4 and communicatively coupled to the elevator controller 6. The controller unit 26 includes a processor programmed to detect an abnormal travel behavior of the counterweight 4. In one embodiment, the proximity sensors 24.1, 24.2 are always on (i.e., active) when the elevator installation 1 is in operation and, therefore, continuously output sensor signals fed to input ports of the processor. The processor, however, polls each input port only at predetermined polling intervals, and determines the voltage of the sensor signal applied to the respective input port. In another embodiment, the processor may activate each proximity sensor 24.1, 24.2 only during the polling intervals and determine the voltage of the sensor signal applied to the respective input port at these intervals. Either way, this process is referred to as polling the proximity sensors 24.1, 24.2.

Each sensor signal output by a proximity sensor 24.1, 24.2 is indicative of whether or not the proximity sensor 24.1, 24.2 is in proximity of the guide rail 16. The processor processes each sensor signal, e.g., by comparing its current value with a stored value (e.g., within the controller unit 26) determined under normal operation. The processor generates an alarm signal if the current value deviates from the stored value indicating that the proximity sensor 24.1, 24.2 is not in proximity of the guide rail 16 and that an abnormal travel behavior of the counterweight 4 exists. As the controller unit 26 is coupled to the elevator controller 6, the processor sends the alarm signal to the elevator controller 6. The elevator controller 6 reacts in accordance with the emergency routine described above to switch the elevator installation to a secure state.

For failsafe reasons, if one of the proximity sensors 24.1, 24.2 fails and does not send a sensor signal even though the controller unit 26 is operational, the controller unit 26 generates an alarm signal. Also, a communications protocol between the controller unit 26 and the proximity sensors 24.1, 24.2, or redundancy of components may be implemented to further improve the elevator installation's failsafe behavior.

In one embodiment, the elevator installation 1 is switched to a secure state if only one of the proximity sensors 24.1, 24.2 leaves the proximity of the guide rail 16. Under certain circumstances, e.g., due to an impact to the building other than an earthquake, or normal counterweight bouncing due to spring loaded guide shoes a false indication of a derailment may happen. This may also happen when power variations cause a "race" condition where the 24V voltage loses power just ahead of the detection side, or on power-up when the detection side of the circuit is operational before the 24V supply is operational. To avoid these false indications, a predetermined delay is implemented. That is, the indication of a derailment must exist for a predetermined time before the elevator controller 6 acts. That predetermined time is implemented in the elevator controller 6 as a delay time, e.g., about 100 ms-about 300 ms, preferably about 200 ms. The elevator controller 6 waits until the delay time expires before acting upon the derailment indication.

The skilled person will appreciate that a derailment may occur in several ways. For example, a guide shoe may lose contact with the guide rail 16 on only one side of the counterweight 4, or both guide shoes on the same side may lose contact. As the embodiment of FIG. 2 has four guide shoes 20.1-20.4 various possibilities exist for losing contact with the guide rails. Therefore, the number of proximity sensors 24.1, 24.2 is selected to achieve a maximum of security for the most likely derailment scenario When the elevator installation 1 is in operation, a process is performed that is configured to detect any abnormal travel behavior of a movable body (2, 4) regardless of what kind of derailment detection system 24 (i.e., the system of FIG. 2 or FIG. 5) is used. The process may be implemented as a software program running in the elevator controller 6. The process monitors an electrical circuit including the proximity sensor 24.1, 24.2 mounted on the movable body (2, 4) to be at a predetermined distance to the guide rail 16 and configured to detect whether or not the proximity sensor 24.1, 24.2 is at the predetermined distance to the guide rail 16 for an indication that the proximity sensor 24.1, 24.2 is not at the predetermined distance to the guide rail 16. Further, that process switches the elevator installation 1 to a secure state in response to the indication that the proximity sensor 24.1, 24.2 is not at the predetermined distance to the guide rail 16.

It is apparent that there has been disclosed an improved mechanism for detecting an abnormal travel behavior of a movable body (2, 4) travelling along a guide rail 16, such as an actual or potential derailment of the movable body. That mechanism avoids the concerns associated with known mechanisms because it is less affected by disturbances such as sway caused by wind, dirt, smoke or wear and tear of moving mechanical parts. In particular, the improved mechanism is independent of a particular configuration of the elevator installation 1. This results in greater flexibility as the derailment detection system does not set limitations in the configuration of the elevator installation. The fact that various kinds of proximity sensors may be used further contributes to the flexibility. That flexibility is achieved without increasing the system's complexity since monitoring a voltage suffices, as described above.

What is claimed is:

1. An elevator installation, comprising:

a guide rail having a predetermined length;

a movable body configured to move along the guide rail up and down a hoistway;

a proximity sensor mounted on the movable body to be at a predetermined distance to the guide rail, wherein the proximity sensor is configured to detect whether or not the proximity sensor is at the predetermined distance to the guide rail; and a controller coupled to the proximity sensor to act upon an indication that the proximity sensor is not at the predetermined distance to the guide rail to switch the elevator installation to a secure state.

2. The elevator installation of claim 1, wherein the proximity sensor includes one of a capacitive sensor, an inductive sensor, a magnetic sensor, an optical sensor and a radar sensor.

3. The elevator installation of claim 1, wherein the guide rail has a T-shaped cross section formed by a base and a blade, and wherein the proximity sensor is positioned to face a front area of the blade.

4. The elevator installation of claim 1, wherein the movable body is a counterweight guided by two counterweight guide rails.

5. The elevator installation of claim 3, comprising at least two proximity sensors and two counterweight guide rails, each proximity sensor mounted on the counterweight to face a front area of a blade of a counterweight guide rail.

6. The elevator installation of claim 5, wherein the at least two proximity sensors are connected in series in an electrical circuit coupled to the controller, wherein each proximity sensor is configured to disrupt the electrical circuit if it is not at the predetermined distance to the guide rail.

7. The elevator installation of claim 6, wherein the indication that the proximity sensor is not at the predetermined distance to the guide rail is a voltage or current of a predetermined value, wherein the controller acts upon a determination that a value of a determined voltage or current is not the predetermined value.

8. The elevator installation of claim 7, wherein each proximity sensor is configured as a proximity switch, wherein an open proximity switch results in a determination that the value of the determined voltage or current is not the predetermined value.

9. The elevator installation of claim 4, wherein at least one proximity sensor faces a first one the counterweight guide rails and at least one proximity sensor faces a second one of the counterweight guide rails.

10. The elevator installation of claim 1, wherein the controller is configured to act upon an expiration of a predetermined delay time.

11. A method of operating an elevator installation, in which a movable body travelling along a guide rail of the elevator installation is subject to an abnormal travel behavior, comprising:

monitoring an electrical circuit comprising a proximity sensor mounted on the movable body to be at a predetermined distance to the guide rail and configured to detect whether or not the proximity sensor is at the predetermined distance to the guide rail for an indication that the proximity sensor is not at the predetermined distance to the guide rail; and switching the elevator installation to a secure state in response to the indication that the proximity sensor is not at the predetermined distance to the guide rail.

12. The method of claim 11, wherein switching the elevator installation to a secure state includes disabling operation of the elevator installation.

13. The method of claim 12, wherein monitoring the electrical circuit includes measuring a voltage or current at the electrical circuit to determine whether or not the voltage or current corresponds to a predetermined voltage.

14. The method of claim 11, wherein switching the elevator installation to a secure state occurs upon an expiration of a predetermined delay time.

* * * * *